US007578372B1

(12) United States Patent
Green

(10) Patent No.: US 7,578,372 B1
(45) Date of Patent: Aug. 25, 2009

(54) AEROSOL LUBRICANT AND DISPENSING METHOD

(76) Inventor: Ronald D. Green, 13595 Cable Rd., Pataskala, OH (US) 43062

( * ) Notice: Subject to any disclaimer, the term of this patent is extended or adjusted under 35 U.S.C. 154(b) by 1752 days.

(21) Appl. No.: 10/172,726

(22) Filed: Jun. 17, 2002

Related U.S. Application Data

(63) Continuation-in-part of application No. 09/531,424, filed on Mar. 20, 2000, now abandoned, which is a continuation-in-part of application No. 08/637,612, filed on Apr. 25, 1996, now abandoned.

(51) Int. Cl.
*F16L 35/00* (2006.01)

(52) U.S. Cl. ..... 184/6.26; 184/109; 239/337; 208/19; 585/1; 285/94

(58) Field of Classification Search ..... 184/6.26, 184/109; 239/337; 285/94; 208/18–19; 224/148.7, 251; 585/1
See application file for complete search history.

(56) References Cited

U.S. PATENT DOCUMENTS 3,805,918 A * 4/1974 Altgelt et al. ..... 184/109
4,141,472 A * 2/1979 Spitzer et al. ..... 239/337
5,057,243 A * 10/1991 Becker et al. ..... 516/8
5,296,021 A * 3/1994 Clapp et al. ..... 106/2

OTHER PUBLICATIONS

Handbook of PVC Pipe; Design and Construction, pp. 33 and 47, published by Uni-Bell PVC Pipe Association, Dallas, Texas, 1993.*
The American Heritage Dictionary of the English Language, (4th ed. 2004).*
Material Safety Data Sheet, WD-40, WD-40 Company, (1986).*

* cited by examiner

*Primary Examiner*—Christopher Verdier
(74) *Attorney, Agent, or Firm*—Richard L. Huff

(57) ABSTRACT

An aerosol container containing a propellant and a highly hydrogenated mineral oil lubricant for the lubrication of gaskets in pipe segments. Preferred propellants are normally gaseous hydrocarbons. The preferred lubricant is the compound identified by the Chemical Abstracts Registry No. 8042-47-5. Preferred gaskets are those made of SBR, BR, EPM. And EPDM. A preferred actuating valve is an omnidirectional valve.

12 Claims, 2 Drawing Sheets

AEROSOL LUBRICANT AND DISPENSING METHOD

CROSS-REFERENCE TO RELATED APPLICATIONS

This application is a continuation-in-part of Ser. No. 09/531,424 filed Mar. 20, 2000, now abandoned, which is a continuation-in-part of Ser. No. 08/637,612, filed Apr. 25, 1996, now abandoned.

BACKGROUND OF THE INVENTION

1. Field of the Invention

This invention is related to aerosol compositions comprising highly hydrogenated mineral oil and a method of lubricated gasketed pipes with these compositions.

2. Description of the Related Art

Pipes made of wood, concrete, metal, and plastic for the transportation of water are old in the art. For the transportation of water over long distances, it is common to prepare pipes made of sections of convenient size to be connected together. One common way of connecting pipe segments is the bell and spigot arrangement in which the spigot of one section fits into the bell of the adjoining section. This generally involves inserting the male end of the spigot section into the female end of the bell section to form a tight fit. In order to assure a tight, waterproof seal, it is common to use a flexible gasket in one of the sections, usually the bell section. A lubricant is commonly employed in order to facilitate insertion of the spigot into the bell.

In the laying of pipe sections underground to be used as water pipe, a number of factors must be taken into consideration.

The lubricant must not be toxic to humans as quantities of the lubricant may dissolve in the water and be consumed in drinking water.

The lubricant must be compatible with the pipe and gasket. A lubricant which reacts with and decomposes the gasket and/or the piping material could cause leaks in the system requiring expensive digging and replacement of the piping. A high percentage of gaskets for water pipes is made of butadiene-styrene rubber (SBR), butadiene rubber (BR) and ethylene-propylene copolymers (EPM and EPDM). The *Handbook of PVC Pipe; Design and Construction*, pages 33 and 47, published by Uni-Bell PVC Pipe Association, Dallas, Tex. (1993) discloses that mineral oil is not compatible with SBR, BR, EPM, and EPDM.

The lubricant should be able to be easily and economically applied. Conventionally, water pipe is laid in trenches which are 2-3 meters deep. The application of lubricant to the gaskets of the pipes usually involves the application of liquid lubricant from an open container with a swab. Under confined working conditions, the open container of lubricant may become spilled or the lubricant may become contaminated. Thus, prior to the present invention, the installer would apply liquid lubricant to the pipe with a brush, rag, or swab. The lubricant would be in an open container which must be held by the installer during application of the lubricant, and then set aside after use. Often, the lubricant container would be set on the edge of the trench with the risk of being spilled or contaminated.

The lubricant should permit ease of installation of the pipes following application. Conventional lubricants allow only a very few seconds for the installer to bring the pieces of pipe into proper alignment.

The problem of spillage, contamination, and waste was addressed by Roux in U.S. Pat. No. 4,641,858. In the Roux patent, the gasket contains a reserve of lubricant which is automatically expelled upon coupling of the pipes. The gaskets of Roux are not economical to produce.

From the above discussion, it is apparent that there remains a need for a lubricating composition which is safe for use in water pipes with regard to ability to be safely ingested by humans and reactivity with the pipes, is economical to produce, is simple to apply and gives the installer adequate time to align the pipe.

SUMMARY OF THE INVENTION

The object of the present invention is to eliminate the above disadvantages inherent in the prior art lubricants and to provide a lubricant for gasketed water pipes which is not toxic to humans, will not deteriorate the pipes or the gaskets, is easy and economical to apply, and provides adequate time for the installer to align the pipes.

To accomplish these ends, applicant has discovered that the old compound, highly hydrogenated mineral oil, identified as Chemical Abstracts Registry No. 8042-47-5 is suitable for the purposes of the present invention. It is made clear that while applicant properly concedes that the compound, itself, is known, applicant knows of no properties of this compound which are known to the prior art which would enable those skilled in the art to practice the invention as described below.

The compound of the present invention may be safely used for the purposes of this invention as it is not toxic to humans.

It has been surprisingly found that the compound of this invention does not adversely react with SBR, BR, EPM, and EPDM, and is thus compatible with commonly used gasket materials without the problem of causing leaking pipes.

The compound of this invention is applied to pipe gaskets in the form of an aerosol. This allows for ease and economy of application and ease of installation of the pipes following application. The aerosol composition may be incorporated into an aerosol container having an omnidirectional valve developed by the inventor and disclosed in U.S. application Ser. No. 09/905,373 filed Jul. 16, 2001, now U.S. Pat. No. 6,654,704, which application is incorporated in its entirety by reference. The possibility of contamination is avoided. The installer can see where the compound has been applied as a colorant is used. Because of this method of application, the time available for aligning the pipes is increased.

DESCRIPTION OF THE PREFERRED EMBODIMENTS

The preferred embodiments will now be described with reference to the above drawing, like identifying numerals referring to like features throughout the description.

Figure 1:
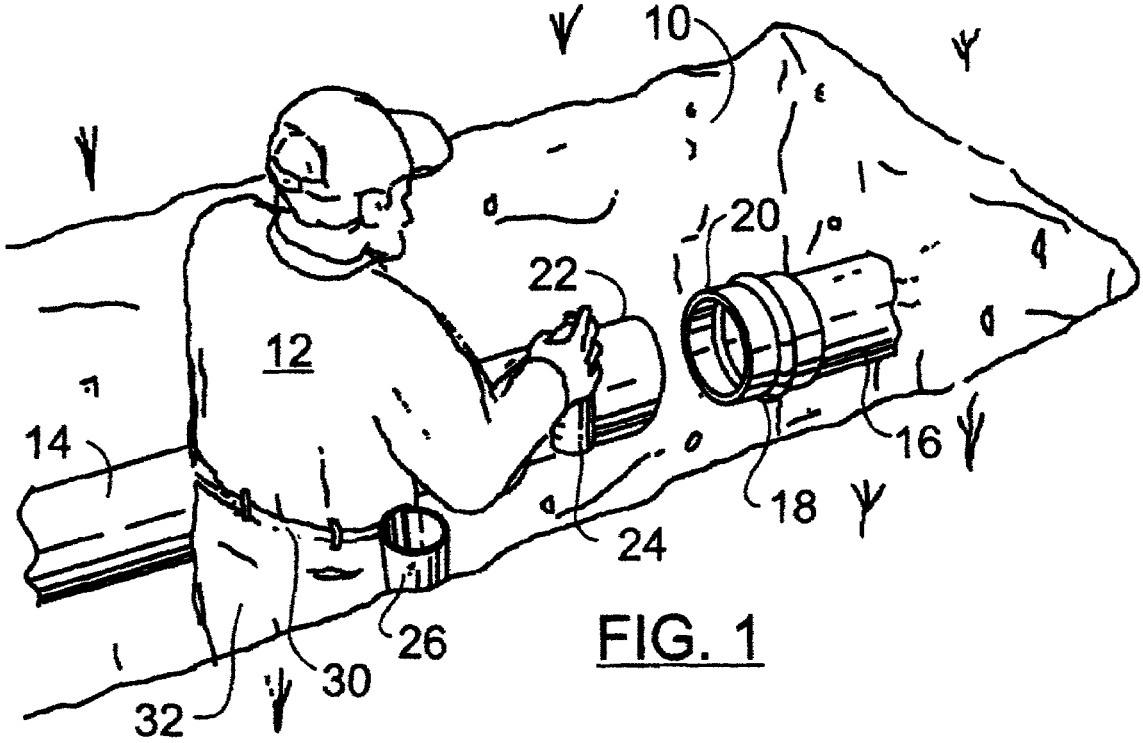
FIG. 1 is an elevational perspective view of a trench wherein an installer is laying water pipe by joining gasketed pipe sections wherein provision is made to use the system of the present invention.
Figure 2:
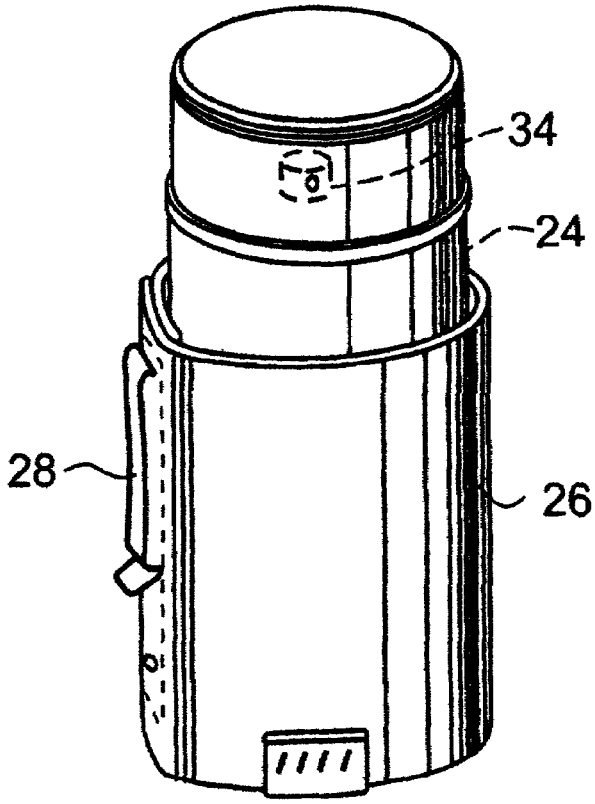
FIG. 2 is an elevational perspective view of the aerosol lubricant container disposed in a holster.
Figure 3:
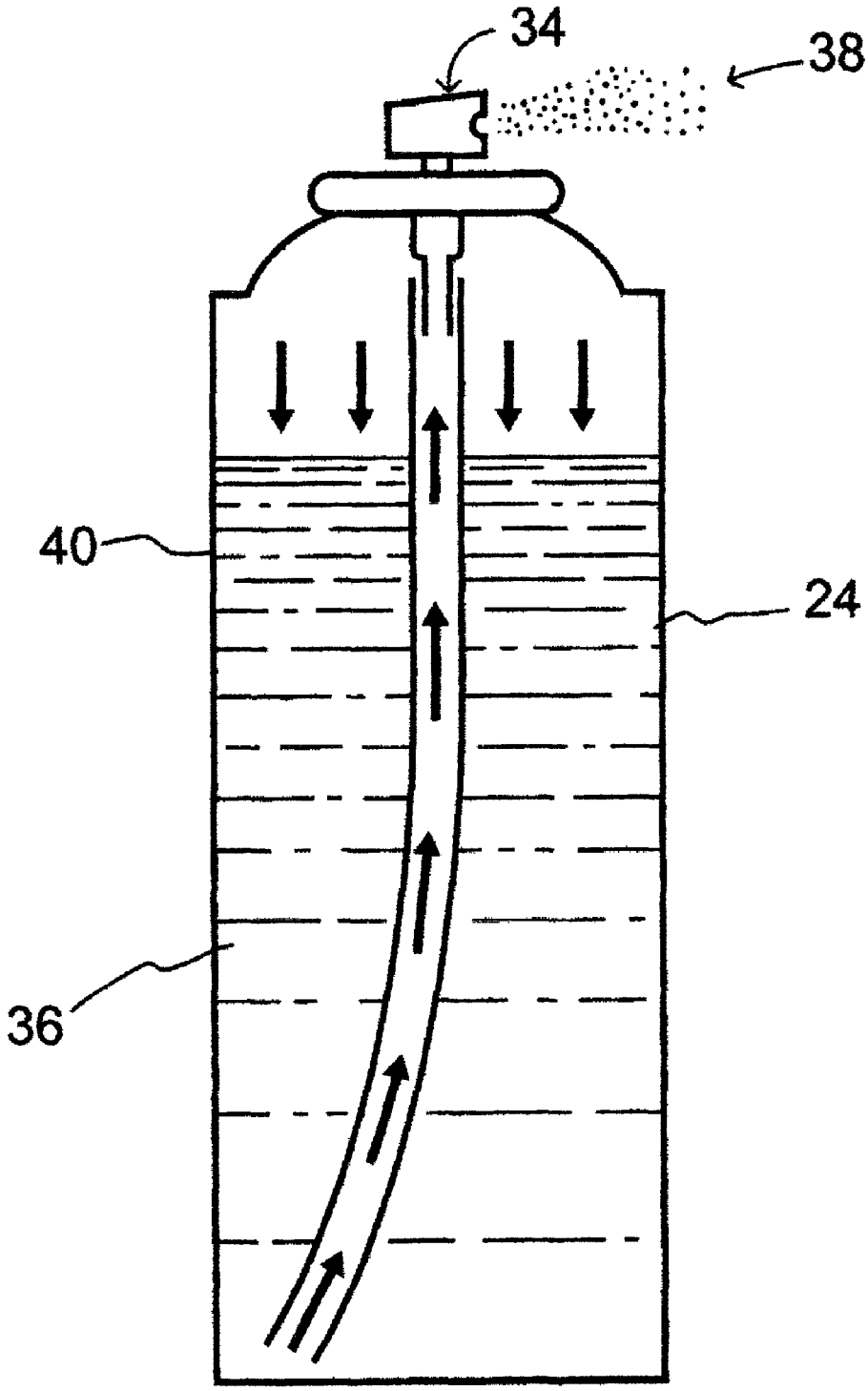
FIG. 3 is a cross-sectional view of an aerosol container with contents used in the present invention.

With reference to FIGS. 1-3, a trench 10, typically 2-3 meters in depth is dug wherein water pipe is to be laid. An installer 12 joins the sections 14, 16 of the pipe. Conventionally, a male spigot end 22 of one segment 14 is fitted into the female bell end 20 of another segment 16. Usually, the bell end 20 contains a gasket 18 to assure a water-tight seal. This invention is not limited to this configuration as the spigot end 22 may contain the gasket 18. Although it is preferred that the gasket 18 may be made of SBR, BR, EPM, or EPDM, any conventional material for use in gaskets 18 may be used. To allow for proper movement between the spigot 22 and the bell 20 and to ensure a water-tight seal between the pipe and the gasket 18, a lubricant is applied to the gasket 18.

The present invention does not rely on an open container for application of the lubricant, but instead uses an aerosol container 24 which may be carried by the installer 12 in a holster 26. The holster 26 is made of durable material, preferably leather, and is fitted with a clip 28 which permits the holster to be clipped onto a belt 30 or onto the top of the pants 32 of the installer 12.

In order to apply the lubricant 40 of this invention to a gasket 18, the installer 12 can withdraw the aerosol container 24 from the holster 26, position the container 24 so that the aerosol spray 38 will come in contact with the gasket 18, and actuate the valve 34 of the container 24. Once the lubricant 40 has been applied to the gasket 18, the aerosol container 24 can be returned to the holster 26 for safe transport.

The aerosol container 24 contains a lubricant system comprising or consisting essentially of lubricant 40 and a propellant.

The inventor has surprisingly found that highly hydrogenated mineral oil, preferably that compound with the Chemical Abstracts Registry No. 8042-47-5, is an ideal lubricant as it is non-toxic to humans, non-reactive with known pipe and gasket 18 materials, and provides good lubrication.

In order to demonstrate the unexpected property of non-reactivity of the highly hydrogenated mineral oil of the invention with common gasket materials, the following tests were conducted to demonstrate that, in contrast to mineral oils as a class are known to do, the highly hydrogenated mineral oil of the present invention does not adversely affect SBR, EPDM, and isoprene.

Composition Tested

A composition containing:

1) 18.09% of the compound highly hydrogenated mineral oil having the Chemical Abstracts Registry No. 8042-47-5 in gelled form;
2) 18.09% of petrolatum;
3) 24.7% of the compound highly hydrogenated mineral oil having the Chemical Abstracts Registry No. 8042-47-5 in liquid form;
4) 39.07% of hydrocarbon propellant; and
5) less than 0.05% beta-carotene colorant was prepared. This composition comes within the scope of the present invention.

Conditions of Test

The compatibility of this composition with SBR, EPDM and isoprene gaskets was tested by spraying the gaskets with the test composition at a level consistent with the coverage needed to make a successful joint assembly. After applying the test composition to each of the gaskets, the gaskets were separated into groups which were subjected to the following conditions:

1) the gaskets were allowed to sit for one week at ambient temperature;
2) the gaskets were allowed to sit for one week in the sun;
3) the gaskets were heated to 140° F. for 24 hours to simulate high temperature field conditions;
4) the gaskets were cooled to 0° F. for 24 hours;

Physical Properties Tested

After being subjected to the above conditions, each gasket was subjected to the following ASTM testing to determine if the test composition affected the gaskets' physical properties:

1) Durometer-D 220 (average of 4 readings);
2) Tensile and Elongation-D 412;
3) Compression Set-D 395;
4) Dimensional Cross Section (test for volume change in gasket) measure height, width, ID, and OD in four areas—Optical comparator and pi-tape.

These physical properties are crucial to the gaskets' performance of service.

Tests were conducted on gaskets which had not been subjected to treatment to serve as controls.

Results

In the following report, durometer is reported in change points, tensile strength is reported in change %, elongation is reported in change %, compression is reported in change % following 22 hrs at 70° C., and dimensional change is reported in

| C-900 Reibar gasket | Test #1 | Test #2 | Test #3 | Test 4 |
|---|---|---|---|---|
| Durometer | N/C | −1 | −2 | N/C |
| Tensile Strength | N/C | N/C | N/C | N/C |
| Elongation | N/C | N/C | N/C | N/C |
| Compression Set | N/C | N/C | N/C | N/C |
| Dimensional Change | | | | |
| H | N/C | N/C | N/C | N/C |
| W | N/C | N/C | N/C | N/C |
| ID | N/C | N/C | N/C | N/C |
| OD | N/C | N/C | N/C | N/C |

| Sewer | Test #1 | Test #2 | Test #3 | Test #4 |
|---|---|---|---|---|
| Durometer | N/C | −1 | −1 | N/C |
| Tensile Strength | N/C | N/C | N/C | N/C |
| Elongation | N/C | N/C | N/C | N/C |
| Compression Set | N/C | N/C | N/C | N/C |
| Dimensional Change | | | | |
| H | N/C | N/C | N/C | N/C |
| W | N/C | N/C | N/C | N/C |
| ID | N/C | N/C | N/C | N/C |
| OD | N/C | N/C | N/C | N/C |

| IPS | Test #1 | Test #2 | Test #3 | Test #4 | Test #5 |
|---|---|---|---|---|---|
| Durometer | N/C | −1 | −1 | −1 | −2 |
| Tensile Strength | N/C | N/C | N/C | N/C | N/C |
| Elongation | N/C | N/C | N/C | N/C | N/C |
| Compression Set | N/C | N/C | N/C | N/C | N/C |
| Dimensional Change | | | | | |
| H | N/C | N/C | N/C | N/C | N/C |
| W | N/C | N/C | N/C | N/C | N/C |
| ID | N/C | N/C | N/C | N/C | N/C |
| OD | N/C | N/C | N/C | N/C | N/C |

| Metric Sewer | Test #1 | Test #2 | Test #3 | Test 4 |
|---|---|---|---|---|
| Durometer | N/C | −1 | −2 | N/C |
| Tensile Strength | N/C | N/C | N/C | N/C |
| Elongation | N/C | N/C | N/C | N/C |
| Compression Set | N/C | N/C | N/C | N/C |
| Dimensional Change | | | | |
| H | N/C | N/C | N/C | N/C |
| W | N/C | N/C | N/C | N/C |
| ID | N/C | N/C | N/C | N/C |
| OD | N/C | N/C | N/C | N/C |

| Concrete O Ring | Test #1 | Test #2 | Test #3 | Test 4 |
|---|---|---|---|---|
| Durometer | N/C | −1 | −2 | N/C |
| Tensile Strength | N/C | N/C | N/C | N/C |
| Elongation | N/C | N/C | N/C | N/C |
| Compression Set | N/C | N/C | N/C | N/C |
| Dimensional Change | | | | |
| H | N/C | N/C | N/C | N/C |
| W | N/C | N/C | N/C | N/C |
| ID | N/C | N/C | N/C | N/C |
| OD | N/C | N/C | N/C | N/C |

| Coupling Gasket | Test #1 | Test #2 |
|---|---|---|
| Durometer | N/C | N/C |
| Tensile Strength | N/C | N/C |
| Elongation | N/C | N/C |
| Compression Set | N/C | N/C |
| Dimensional Change | | |
| H | N/C | N/C |
| W | N/C | N/C |
| ID | N/C | N/C |
| OD | N/C | N/C |

CONCLUSION

The objective of the above tests was to determine the effect of a composition containing the compound having the Chemical Abstracts Registry No. 8042-47-5 on standard gaskets. All tests were conducted to simulate in-field uses of the composition. The only variable introduced into the testing was the compound having the Chemical Abstracts Registry No. 8042-47-5. Conclusions can be drawn comparing the test samples with and without treatment with the compound.

When testing gasket material compatibility with foreign substances, it is concluded that if physical properties change in the magnitude of less than 5% or there is a durometer change of less than 5 pt., when the gasket material is subjected to contact with the foreign substance in the ways described above, the gasket material is considered compatible or resistant to the foreign substance and should perform its intended function with no or little long-term degradation of performance.

The test data lead to the conclusion that the compound having the Chemical Abstracts Registry No. 8042-47-5 has little or no effect on the gasket material when compared to the gasket material not treated with this compound and that this compound should have no short- or long-term effects on the standard industry gaskets when properly applied.

The propellant is not critical, although normally gaseous hydrocarbons, e.g., isobutane, propane, or mixtures thereof, perform satisfactorily for this purpose and are inexpensive and safe. The propellant is used in an amount effective to propel the lubricant 40 from the container 24 to the gasket 18. This amount differs with the nature of the propellant, and is easily determined by routine experimentation.

A typical lubricant composition comprises or consists essentially of between about 25 and 45 weight % propellant and between about 55 and 75 weight % of lubricant 40.

The preferred lubricant composition comprises between about 25 and 45 weight % isobutane, between about 5 and 15 weight % propane, and between 55 and 75 weight % of the compound identified by the Chemical Abstracts Registry No. 8042-47-5. This composition is suitable for aerosol containers 24 which discharge at all angles. The lubricant 40 empties completely and the composition functions at ambient temperatures, even those below 40° F.

While a container 24 fitted with a valve 34 for dispensing pressurized contents from within the container 24 has been described, it will be appreciated that any conventional system for dispensing pressurized materials from within a container 24 may be employed within the spirit of this invention. A conventional aerosol can 24 with a valve 34 has been used to illustrate the present invention as such containers 24 are ubiquitous commercial products that enable cost effective and efficient manufacture of the lubricant composition of this invention.

While the preferred embodiment has been described with reference to water pipes, it will be appreciated that a variety of other uses for gasketed pipes are known in the art. For example, sewer pipes, process pipes used in factories, and the like may be used. The present invention is intended for use with any piping which requires the use of lubricated gaskets 18.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. The method of lubricating gasketed pipes comprising providing an aerosol container having an actuating discharge valve containing a pressurized lubricating composition consisting essentially of a highly hydrogenated mineral oil lubricant and an amount of propellant effective to propel the lubricant, so that when the discharge valve of the container is actuated, an aerosol spray will be dispensed from the container, positioning the container so that the aerosol spray will come in contact with the gasket, and actuating the valve.

2. The method of lubricating gasketed pipes comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, so that when the discharge valve of the container is actuated, an aerosol spray will be dispensed from the container, positioning the container so that the aerosol spray will come in contact with the gasket, and actuating the valve.

3. The method of lubricating gasketed pipes comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, wherein the lubricating composition consists essentially of between about 25 and 45 weight % propellant and between 55 and 75% lubricant, so that when the discharge valve of the container is actuated, an aerosol spray will be dispensed from the container, positioning the container so that the aerosol spray will come in contact with the gasket, and actuating the valve.

4. The method of lubricating gasketed pipes comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, wherein the lubricating composition consists essentially of between about 25 and 45 weight % propellant and between 55 and 75% lubricant, wherein the propellant is a normally gaseous hydrocarbon, so that when the discharge valve of the container is actuated, an aerosol spray will be dispensed from the container, positioning the container so that the aerosol spray will come in contact with the gasket, and actuating the valve.

5. The method of lubricating gasketed pipes comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, wherein the lubricating composition consists essentially of between about 25 and 45 weight % propellant and between 55 and 75% lubricant, wherein the propellant is a normally gaseous hydrocarbon, wherein the lubricating composition consists essentially of between about 25 and 45 weight % isobutane, between about 5 and 15 weight % propane, and between about 55 and 75 weight % lubricant, so that when the discharge valve of the container is actuated, an aerosol spray will be dispensed from the container, positioning the container so that the aerosol spray will come in contact with the gasket, and actuating the valve.

6. The method of lubricating gasketed pipes comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, wherein the lubricating composition consists essentially of between about 25 and 45 weight % propellant and between 55 and 75% lubricant, wherein the propellant is a normally gaseous hydrocarbon, wherein the lubricating composition consists essentially of between about 25 and 45 weight % isobutane, between about 5 and 15 weight % propane, and between about 55 and 75 weight % lubricant, wherein the valve is an omnidirectional valve, so that when the discharge valve of the container is actuated, an aerosol spray will be dispensed from the container, positioning the container so that the aerosol spray will come in contact with the gasket, and actuating the valve.

7. The method of lubricating gasketed pipes wherein the gasket is made from a member of the group consisting of SBR, BR, EPM, and EPDM comprising providing an aerosol container having an actuating discharge valve containing a pressurized lubricating composition consisting essentially of a highly hydrogenated mineral oil lubricant and an amount of propellant effective to propel the lubricant, so that when the discharge valve of the container is actuated, an aerosol spray will be dispensed from the container, positioning the container so that the aerosol spray will come in contact with the gasket, and actuating the valve.

8. The method of lubricating gasketed pipes wherein the gasket is made from a member of the group consisting of SBR, BR, EPM, and EPDM comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, so that when the discharge valve of the container is actuated, an aerosol spray will be dispensed from the container, positioning the container so that the aerosol spray will come in contact with the gasket, and actuating the valve.

9. The method of lubricating gasketed pipes wherein the gasket is made from a member of the group consisting of SBR, BR, EPM, and EPDM comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, wherein the lubricating composition consists essentially of between about 25 and 45 weight % propellant and between 55 and 75% lubricant, so that when the discharge valve of the container is actuated, an aerosol spray will be dispensed from the container, positioning the container so that the aerosol spray will come in contact with the gasket, and actuating the valve.

10. The method of lubricating gasketed pipes wherein the gasket is made from a member of the group consisting of SBR, BR, EPM, and EPDM comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, wherein the lubricating composition consists essentially of between about 25 and 45 weight % propellant and between 55 and 75% lubricant, wherein the propellant is a normally gaseous hydrocarbon, so that when the discharge valve of the container is actuated, an aerosol spray will be dispensed from the container, positioning the container so that the aerosol spray will come in contact with the gasket, and actuating the valve.

11. The method of lubricating gasketed pipes wherein the gasket is made from a member of the group consisting of SBR, BR, EPM, and EPDM comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, wherein the lubricating composition consists essentially of between about 25 and 45 weight % propellant and between 55 and 75% lubricant, wherein the propellant is a normally gaseous hydrocarbon, wherein the lubricating composition consists essentially of between about 25 and 45 weight % isobutane, between about 5 and 15 weight % propane, and between about 55 and 75 weight % lubricant, so that when the discharge valve of the container is actuated, an aerosol spray will be dispensed from the container, positioning the container so that the aerosol spray will come in contact with the gasket, and actuating the valve.

12. The method of lubricating gasketed pipes wherein the gasket is made from a member of the group consisting of SBR, BR, EPM, and EPDM comprising providing an aerosol container having an actuating discharge valve containing a pressurized lubricating composition consisting essentially of a highly hydrogenated mineral oil lubricant and an amount of propellant effective to propel the lubricant, wherein the lubricant is the compound having the Chemical Abstracts Registry No. 8042-47-5, wherein the lubricating composition consists essentially of between about 25 and 45 weight % propellant and between 55 and 75% lubricant, wherein the propellant is a normally gaseous hydrocarbon, wherein the lubricating composition consists essentially of between about 25 and 45 weight % isobutane, between about 5 and 15 weight % propane, and between about 55 and 75 weight % lubricant, wherein the valve is an omnidirectional valve, so that when the discharge valve of the container is actuated, an aerosol spray will be dispensed from the container, positioning the container so that the aerosol spray will come in contact with the gasket, and actuating the valve.

* * * * *

UNITED STATES PATENT AND TRADEMARK OFFICE

CERTIFICATE OF CORRECTION

PATENT NO. : 7,578,372 B1
APPLICATION NO. : 10/172726
DATED : August 25, 2009
INVENTOR(S) : Green It is certified that error appears in the above-identified patent and that said Letters Patent is hereby corrected as shown below:

In Col. 4, line 24, --%.-- has been added following "in".

Signed and Sealed this

Sixth Day of October, 2009

David J. Kappos

David J. Kappos
*Director of the United States Patent and Trademark Office*